US005409380A

United States Patent [19]

Balbuena et al.

[11] Patent Number: 5,409,380

[45] Date of Patent: Apr. 25, 1995

[54] SYSTEM TO ASSIST THE GUIDING OF THE NON-SIGHTED

[76] Inventors: Andres U. Balbuena, Roca Umbert, 11, entl° 2ª, 08907 L'Hospitalet de Llobregat; Armando L. Cantabrana, Aribau, 162–166, 08036, both of Barcelona, Spain

[21] Appl. No.: 897,465

[22] Filed: Jun. 11, 1992

[30] Foreign Application Priority Data

Jun. 13, 1991 [ES] Spain ..... P9101421

[51] Int. Cl.[6] ..... G08B 13/00

[52] U.S. Cl. ..... 434/112; 434/116

[58] Field of Search ..... 434/112, 116; 340/571

[56] References Cited

U.S. PATENT DOCUMENTS 4,954,813 9/1990 August, Sr. et al. ..... 340/573

*Primary Examiner*—Richard J. Apley

*Assistant Examiner*—Glenn E. Richman

*Attorney, Agent, or Firm*—B. Craig Killough

[57] ABSTRACT

A system to assist the guiding of the blind characterized by a modular circuit which is activated by radiation emitted by a circuit worn by the blind person. The stationary modular circuit has a radiation sensor. A trigger with analog digital functions is attached to a microprocessor which has an inlet for an amplifier attached to a speaker which generates spoken transmitted messages. The trigger has outlets connected to a sensitivity adjustment control of the device, and the amplifier carries the control for the adjustment of volume. Included in the same manner are recording and reproduction indicators for signals introduced by the microphone/tape, selectable between possible messages and capable of deactivation. The device is capable of transmission of oral messages after the activation of the circuit by the user.

8 Claims, 1 Drawing Sheet

SYSTEM TO ASSIST THE GUIDING OF THE NON-SIGHTED

BACKGROUND AND SUMMARY OF THE INVENTION

The present invention is directed to a device to help guide the blind.

This device allows the use of a system that facilitates guidance for the non-sighted in a closed location and even in open spaces, if conditions permit. The device is comprised of infrared generators or ultrasound, capable of stimulating the receiving mechanism attached to a voice transmitter that signals with the transmission of a message previously recorded, the user's location, or any other indication useful to the user, therefore establishing a real spoken sign or announcement.

In the prior art, systems to guide the blind are known, such as urban street lights and other similar devices, but such devices prove to be very limited since they are not interactive. In other words, the prior art devices are not operated by the user at a determined moment, but transmit continuously an independent message regardless of proximity to the user, and regardless of whether there is a person present that can make use of these acoustically transmitted signals.

The present invention, which will be described, is fundamentally in two parts; the unit worn by the blind person, which will act as a stimulator to bring about the transmission of the voice message, and the stationary and modular unit mounted in an appropriate place, ready to transmit the indicated message pertaining to the premises, locale, or other similar area.

The unit worn by the blind person consists of an infrared or ultrasound transmitter similar in form to the mechanism used for the remote control channel selection in television sets and other appliances. Its small size allows it to be carried in a pocket.

The stationary, modular unit of the system is comprised of a sensor for the emissions coming from the mobile unit worn by the user, a trigger for generating orders, a special microprocessor for generating voice commands, a microphone with a preamplifier for incoming messages and a recording mechanism for incoming messages, a filter and an amplifier for the voice command transmitter.

The preceding stages are accompanied by a stabilized source of power, a means for sensitivity adjustment and a functioning means to adjust volume.

To facilitate the explanation of the present invention, drawings are presented by way of illustrative examples, and are not an exhaustive presentation of the system to help guide the non-sighted.

DETAILED DESCRIPTION OF THE DRAWINGS

DETAILED DESCRIPTION OF THE PREFERRED EMBODIMENT

Figure 1:
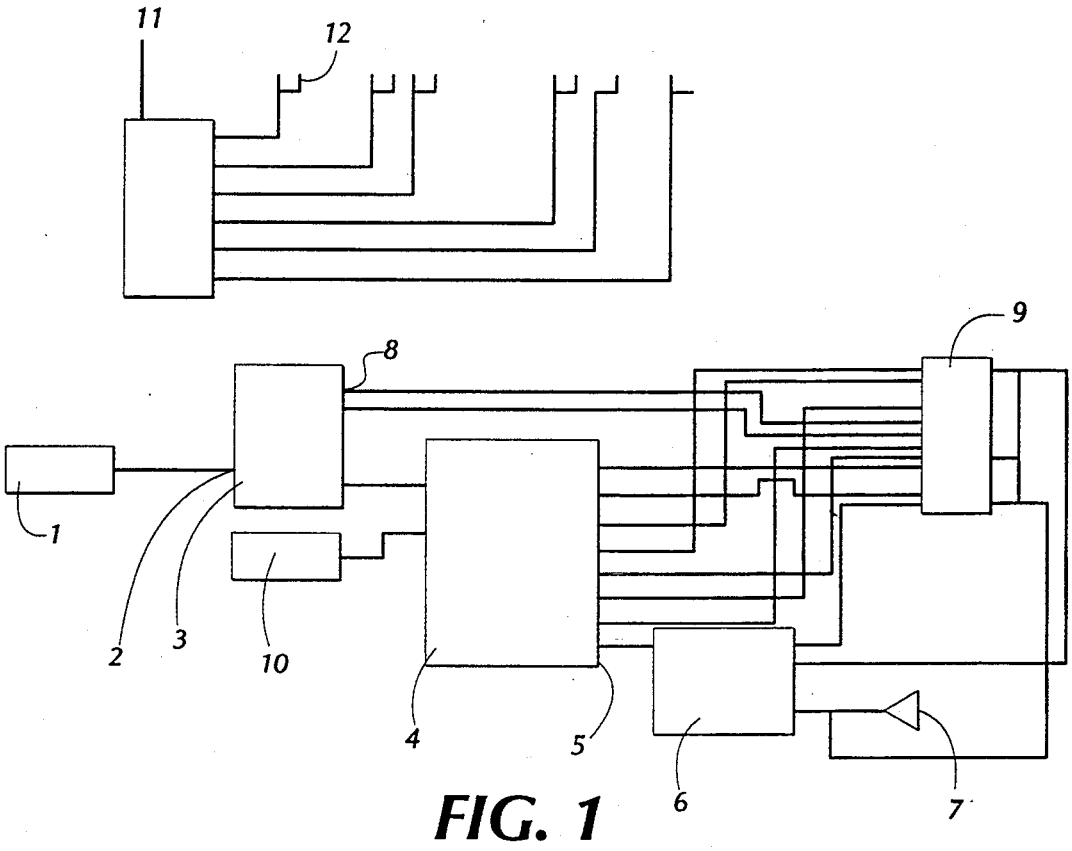
FIG. 1 is a block diagram from the functioning stages of the unit that constitute the stationary unit of the system.

The sensor 1 is activated to receive infrared or ultrasound emissions and transmits a signal received by inlet 2 of the trigger 3 which presents an outlet attached to the microprocessor 4 of a special type for the processing of voice signals.

The resulting interface system delivers digital signals to a microprocessor from which analog signals will be obtained at the outlet 5 for the application of signals to the filter with an amplifier 6, which activates speaker 7, so as to generate spoken messages power source connector, and spoken command generator.

The trigger outlets 8 incorporate, in their association with the connector outlets 9, a potentiometer for the adjustment of the sensitivity of the device, in other words, the distance from which the device can be caused to function by the mobile unit.

The preamplifier 10 is attached to a microphone by means of which the transmission of desired a message will be recorded and afterwards time reproduced upon a previous stimulation of the device by means of the circuit worn by the user.

The modular circuit is completed with the power supply II comprising a transformer connected to the mains, a rectifier, a filter, and a regulator of direct current, obtaining positive and negative polarization in the various terminals 12 as well as grounding outlets.

Figure 2:
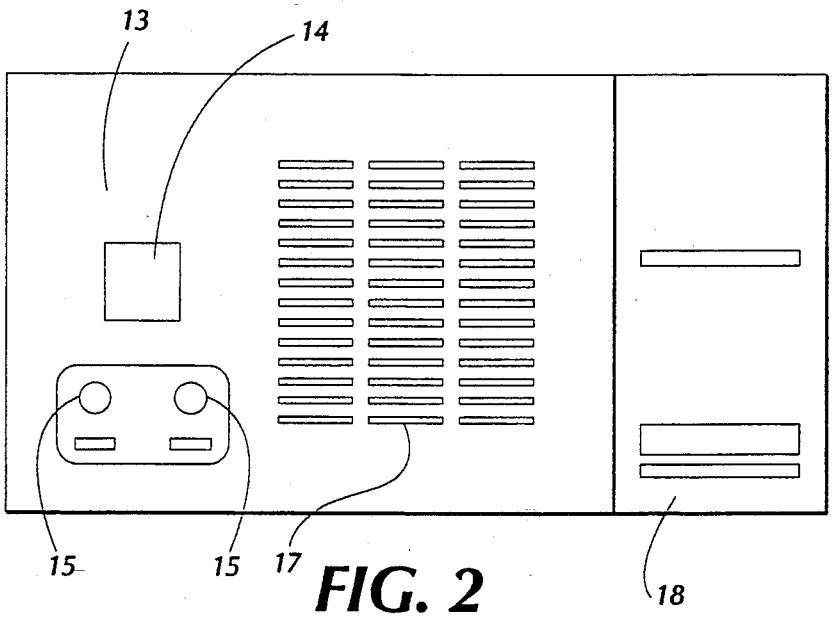
FIG. 2 represents an embodiment of the cover of the housing unit which contains the components of the stationary parts.

In a preferred embodiment, the described module is comprised of a housing unit whose front side has a cover 13 according to FIG. 2, in which a window 14 appears for the purpose of receiving incoming activation signals and having indicator means such as lights 15 indicative of the functioning of the system and voice command and light 16 indicating the voice system operation. Also present in cover 13 is a speaker grille 17 for outgoing voice signals transmitted by the speaker 7 and a lid 18 allows access to the compartment in which the recording and reproduction push buttons are found. Also, in this compartment, the volume and maximum distance regulators are found.

In the preferred embodiment, two possible messages can be chosen as desired. These functions can also be deactivated when the device is not in use. The compartment is independent of the one to the left of the cover 13 comprising the power stage connected to voltage networks. The power source 11 contains a rechargeable sections such as a battery, which will provide power in case of power failure.

The device can be put into practice in other embodiments that differ in detail from the preceding description, but which will equally comprise the spirit of the invention. Construction in any form and size with the adequate materials can be accomplished and will remain in the context of the preferred embodiment.

What is claimed is:

1. A device to assist the guiding of the blind, comprising:

a. a continuously transmitting infrared transmitter worn by a user;

b. an infrared receiver positioned at a remote location from said infrared transmitter which receives an infrared transmission from said infrared transmitter;

c. an analog digital interface which is actuated by said infrared receiver;

d. a microprocessor which is connected to said analog digital interface and is actuated by said infrared receiver receiving an infrared transmission from said continuously transmitting infrared transmitter, wherein said microprocessor has recording means for recording and generating at least one message, and which, upon actuation by said infrared receiver, transmits an audible recorded message to said user;

e. a microphone which is connected to said microprocessor, to allow a message to be recorded by said recording means through said microphone;

f. a preamplifier connected to said microphone and said microprocessor for amplifying messages to said microprocessor;

g. an amplifier connected to an outlet of said microprocessor to amplify a message from said microprocessor; and h. a speaker which is connected to said amplifier through which said audible message is transmitted.

2. A device to assist in the guiding of the blind as described in claim 1, further comprising a potentiometer which is connected to said infrared receiver to provide means to adjust the sensitivity of the device to determine the maximum distance between said infrared receiver and infrared transmitter which will cause actuation of the microprocessor, and wherein the amplifier attached to the speaker further comprises a volume control means.

3. A device to assist in the guiding of the blind as described in claim 1, wherein said recording means has means to record and transmit at least two messages, and has switch means for selection between said messages.

4. A device to assist in the guiding of the blind as described in claim 1, further comprising an assembly located in an interior of a housing unit formed by two independent compartments, wherein one of said compartments contains a feeding stage of a circuit which is connected to a common power network, and has a window therein in which said infrared receiver is located so as to receive infrared signals from said infrared transmitter, and has visual indicator means connected to said microprocessor to indicate operation of the device, and has at least one opening therein in which said speaker is located, and wherein the other of said compartments contains said microprocessor, said amplifier and a volume control means.

5. A device to assist the guiding of the blind, comprising:

a. a continuously transmitting ultrasound transmitter worn by a user;

b. an ultrasound receiver positioned at a remote location from said infrared transmitter which receives a transmission from said transmitter;

c. an analog digital interface which is actuated by said ultrasound receiver;

d. a microprocessor which is connected to said analog digital interface and is actuated by said ultrasound receiver receiving an ultrasound transmission from said continuously transmitting ultrasound transmitter, wherein said microprocessor has recording means for recording and generating at least one message and which upon actuation by said receiver, transmits an audible recorded message to said user;

e. a microphone which is connected to said microprocessor, to allow a message to be recorded by said recording means through said microphone;

f. a preamplifier connected to said microphone and said microprocessor for amplifying messages to said microprocessor;

g. an amplifier connected to an outlet of said microprocessor to amplify a message from said microprocessor; and h. a speaker which is connected to said amplifier through which said audible message is transmitted.

6. A device to assist in the guiding of the blind as described in claim 5, further comprising a potentiometer which is connected to said ultrasound receiver to provide means to adjust the sensitivity of the device to determine the maximum distance between said receiver and transmitter which will cause actuation of the microprocessor, and wherein the amplifier attached to the speaker further comprises a volume control means.

7. A device to assist in the guiding of the blind as described in claim 5, wherein said recording means has means to record and transmit at least two messages, and has switch means for selection between said messages.

8. A device to assist the guiding of the blind as described in claim 5, further comprising an assembly located in an interior of a housing unit formed by two independent compartments, wherein one of said compartments contains a feeding stage of a circuit which is connected to a common power network, and has window therein in which said ultrasound receiver is located so as to receive ultrasound signals from said continuously operating ultrasound transmitter, and has visual indicator means connected to said microprocessor to indicate operation of the device, and has at least one opening therein in which said speaker is located, and wherein the other of said compartments contains said microprocessor, said amplifier and a volume control means.

* * * * *